US007045168B2

(12) United States Patent
Janbakhsh

(10) Patent No.: US 7,045,168 B2
(45) Date of Patent: May 16, 2006

(54) UNIQUE PAINT EFFECTS AND METHODS THEREFOR

(75) Inventor: Mahan Mark Janbakhsh, 9065 Fallswood La., Brentwood, TN (US) 37027

(73) Assignee: Mahan Mark Janbakhsh, Brentwood, TN (US)

( * ) Notice: Subject to any disclaimer, the term of this patent is extended or adjusted under 35 U.S.C. 154(b) by 165 days.

(21) Appl. No.: 10/342,531

(22) Filed: Jan. 15, 2003

(65) Prior Publication Data

US 2005/0031787 A1 Feb. 10, 2005

Related U.S. Application Data

(60) Provisional application No. 60/348,943, filed on Jan. 15, 2002.

(51) Int. Cl.
*B05D 1/32* (2006.01)
*B05D 1/38* (2006.01)

(52) U.S. Cl. ..... 427/154; 427/156; 427/259; 427/261; 427/282

(58) Field of Classification Search ..... 427/154–156, 427/256–288
See application file for complete search history.

(56) References Cited

U.S. PATENT DOCUMENTS

| | | | | | |
|---|---|---|---|---|---|
| 2,365,705 | A | * | 12/1944 | Jeri | 427/154 |
| 2,403,084 | A | * | 7/1946 | James | 428/201 |
| 5,186,978 | A | * | 2/1993 | Woodhall et al. | 427/154 |
| 5,618,578 | A | * | 4/1997 | Blaine et al. | 427/154 |
| 5,741,383 | A | * | 4/1998 | Kneisel | 156/108 |
| 5,876,791 | A | * | 3/1999 | Woodhall et al. | 427/156 |

OTHER PUBLICATIONS

Kirk-Othmer, vol. 6, pp. 705-706, 4th ED, 1993.*

* cited by examiner

*Primary Examiner*—Fred J. Parker
(74) *Attorney, Agent, or Firm*—Waddey and Patterson, PC; Martha B. Allard; James R. Cartiglia

(57) ABSTRACT

The present invention relates to methods and compositions for creating a distinctive painted appearance on the surface of a substrate. The method involves coating a patterning composition on the surface, applying a coating of paint on the surface and removing the patterning composition.

22 Claims, 4 Drawing Sheets
(4 of 4 Drawing Sheet(s) Filed in Color)

UNIQUE PAINT EFFECTS AND METHODS THEREFOR

RELATED APPLICATION

This application claims the benefit under 35 U.S.C. §119 (e) of pending provisional patent application Ser. No. 60/348,943, entitled "PAINT COMPOSITION", filed on Jan. 15, 2002, the details and disclosure of which are incorporated herein by reference.

BACKGROUND OF THE INVENTION

1. Field of the Invention

The present invention relates to compositions and methods for providing a unique appearance to a painted surface. More particularly, the inventive compositions and methods provide a decorative appearance, such as a crystalline pattern, to a painted surface, such as a motor vehicle, a window, a musical instrument, etc.

2. Technical Field

There is an ongoing desire to develop and produce unique paint appearances for a variety of substrates. For instance, the custom motor vehicle industry thrives in part because of a never-ending desire to achieve distinctive paint jobs on cars, trucks, motorcycles and other motor vehicles. Likewise, unique and desirable patterns on windows and other glass objects are being sought, as well as custom paint jobs on guitars and other musical instruments. This applies also to the furniture industry, the construction industry, and to virtually any other industry in which appearance is of significance.

What is desired therefore, are methods and compositions for providing a unique appearance to a substrate.

SUMMARY OF THE INVENTION

An object of the present invention is to provide an improved composition that, among other things, provides a unique appearance to a substrate when applied thereto.

Another object of the present invention is to provide a composition that, when applied to painted surface, or used as part of a paint system, can provide a unique appearance to a substrate when applied thereto.

Another object of the present invention is to provide a method for providing a unique surface appearance to a substrate.

These and other objects of the present invention will become more apparent as the nature of the invention is more fully disclosed.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF THE PREFERRED EMBODIMENTS

Figure 1:
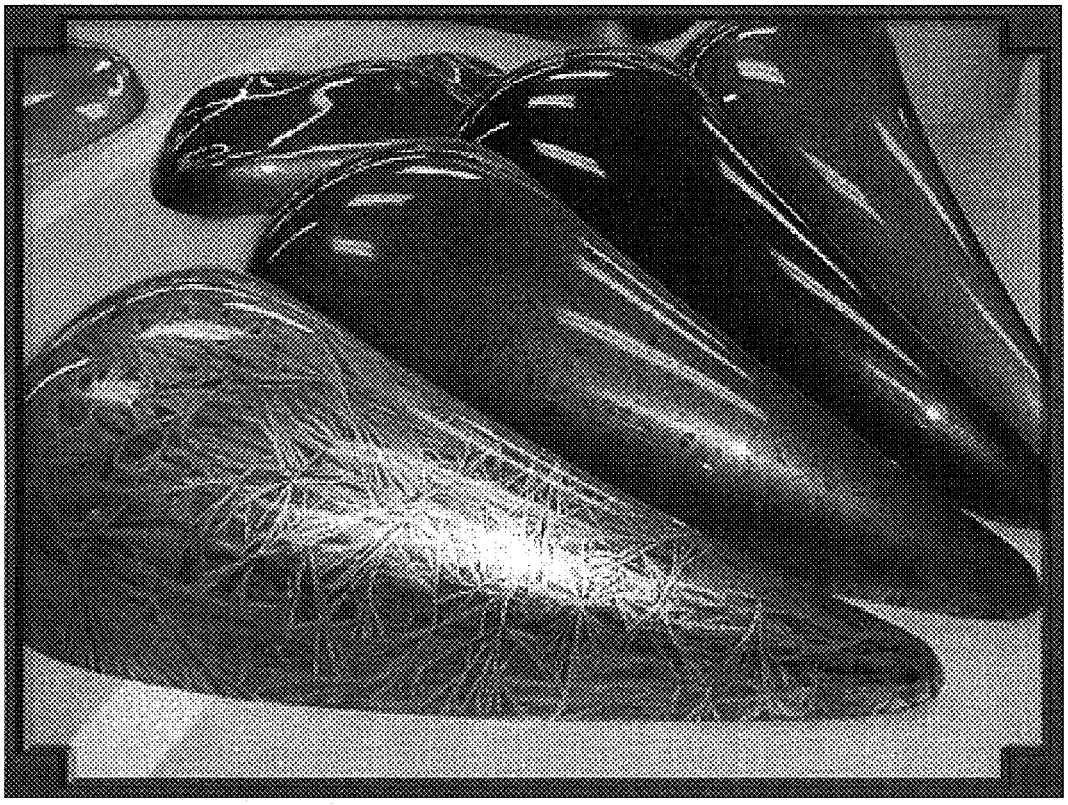
FIGS. 1–4 are photographs of motor vehicle parts that have been prepared using the methods of the present invention.

The present invention relates to a composition and process for producing a uniquely finished smooth surface on a substrate. The finished surface resulting from practice of the invention can be characterized as having a contrasting pattern on the finished surface.

The inventive method comprises applying a patterning composition, more particularly a mixture of a patterning material capable of forming a decorative pattern upon application to the substrate, and then being removed from the substrate after having been painted thereover. Materials useful in the inventive method as the patterning material include nitrogenous compositions, such as urea (typically, "standard" 46-0-0 urea, containing 46% nitrogen), in mixture of solution, preferably aqueous solution. The patterning material should be capable of adhering to the surface of the substrate, and then removal therefrom. Further modifications to the appearance of the substrate can be achieved by the addition of volatile solvents, such as alcohols or ketones, to the patterning material mixture.

The amount of patterning present in the mixture can vary widely, and primarily affects the degree of pattern (such as crystalline) appearance in the finished substrate. For instance, incorporation of a greater amount of the patterning material will result in a more closely packed pattern in the finished substrate, and vice versa. Most desirably, the patterning material is dissolved in the solvent (such as water); therefore, an upper limit to the amount of patterning material in this situation is its solubility limit in the solvent. In the case of urea, in aqueous solution, the urea is preferably present in an amount of about 2.5% to about 50% by weight, more preferably about 15% to about 40% by weight, most preferably about 25% to about 35% by weight. Similarly, the level of patterning material mixture applied to the substrate can vary, depending on the final appearance desired. A thicker application of the mixture will result in a more "dense" appearance, whereas a thinner application will result in a more diffuse or sparse appearance.

The inclusion of a volatile solvent in the patterning mixture can modify the pattern of deposition of the patterning material on the surface of the substrate, and, therefore, the finished appearance created. Although the mechanisms for this are not fully understood, it is believed this is accomplished by altering the viscosity and/or drying time of the patterning mixture on the surface. Although there is no criticality to the amount of volatile solvent included, it is typically present in the patterning mixture at a level of about 0.25% to about 9% by weight, more preferably about 0.75% to about 3% by weight.

The inventive method can be applied to any relatively non-porous surface of a substrate, including metals, glass, wood (rendered nonporous by shellac, pre-painting, etc.), leather, fiberglass, and non-porous plastics (or porous plastics rendered non-porous by shellac, pre-painting, etc.). The substrate can be bare (i.e., unpainted) or it can have a base paint coating, depending on the desired effect, as explained in more detail below. The paint employed, for either the base paint coating, or as the paint applying on the patterning material, can be either oil-based or water-based.

The inventive methods comprise providing a non-porous surface of a substrate, applying (such as by brushing, spraying or other conventional method) to the substrate a crystalline material mixture, applying a coat of paint to the substrate over the patterning material mixture, and removing the patterning material mixture from the substrate. In so doing, the patterning material acts as a stencil or mask for the paint applied thereon. When the patterning material is removed, it removes the paint topcoat in those locations where the patterning material was, resulting in a desirable appearance, such as a crystalline-patterned appearance.

Advantageously, for a higher contrast finished appearance, a base coat of paint, in contrasting color to the paint to be applied over the patterning material mixture, is applied to the substrate prior to the application of the patterning material mixture.

Most preferably, the inventive methods include the steps of: (a) providing a substrate, the surface of which may be pre-painted; (b) lightly sanding the pre-painted surface of the substrate to facilitate adherence of the patterning material thereto; (c) applying a mixture containing a material which forms a decorative pattern, such as a crystalline-structured pattern, upon drying (preferably, an aqueous urea solution); (d) drying the patterning material mixture on the surface of the substrate, such as by blowing air over the surface (by use of a fan, etc.) and/or heating; (e) applying a contrasting coat of paint to the surface of the substrate over the coating of the patterning mixture; (f) drying the contrasting coat of paint; (g) washing the surface of the substrate to remove the patterning material (i.e., urea) which acts as a stencil or mask for the development of the pattern; and (h) applying one or more coats of a protectant material such as varnish or shellac to protect the finished surface and to provide a desirable sheen.

In an alternative embodiment, the patterning mixture can be admixed with the paint to be applied to the surface of the substrate, rather than the paint being applied over the patterning mixture, in order to create a unique and distinctive pattern. This is especially so where the solvent used in the patterning mixture is compatible with the paint base (thus, an aqueous patterning mixture used with water-based paints). In this case, there is no need for removal of the patterning material; a protectant is simply applied thereover.

The appearance of the finished substrate can be modified by varying some or all of the parameters of the inventive method. More particularly, the size, shape, number, distribution, and contrasting appearance of the decorative (i.e., crystalline-shaped) sites on the surface of the substrate can be modified by varying: (a) color and type of paint used for pre-painting; (b) sand paper grit size and degree of sanding of the pre-painted surface; (c) patterning material concentration in solution and type and amount of volatile solvent added; (d) drying rate after application of dissolved patterning material as determined by air flow over surface, air humidity, drying temperature, and amount of volatile solvent in the solution; (e) type and color of contrasting coat of paint, or combinations of the above.

Figure 2:
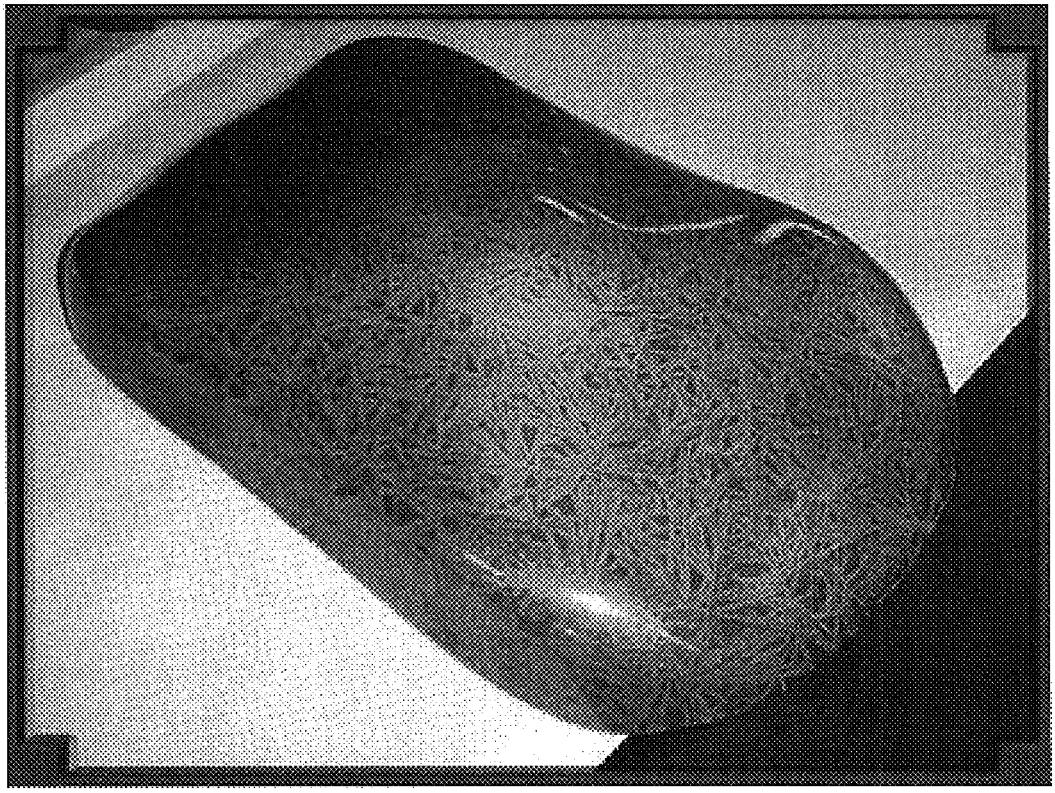
Figure 3:
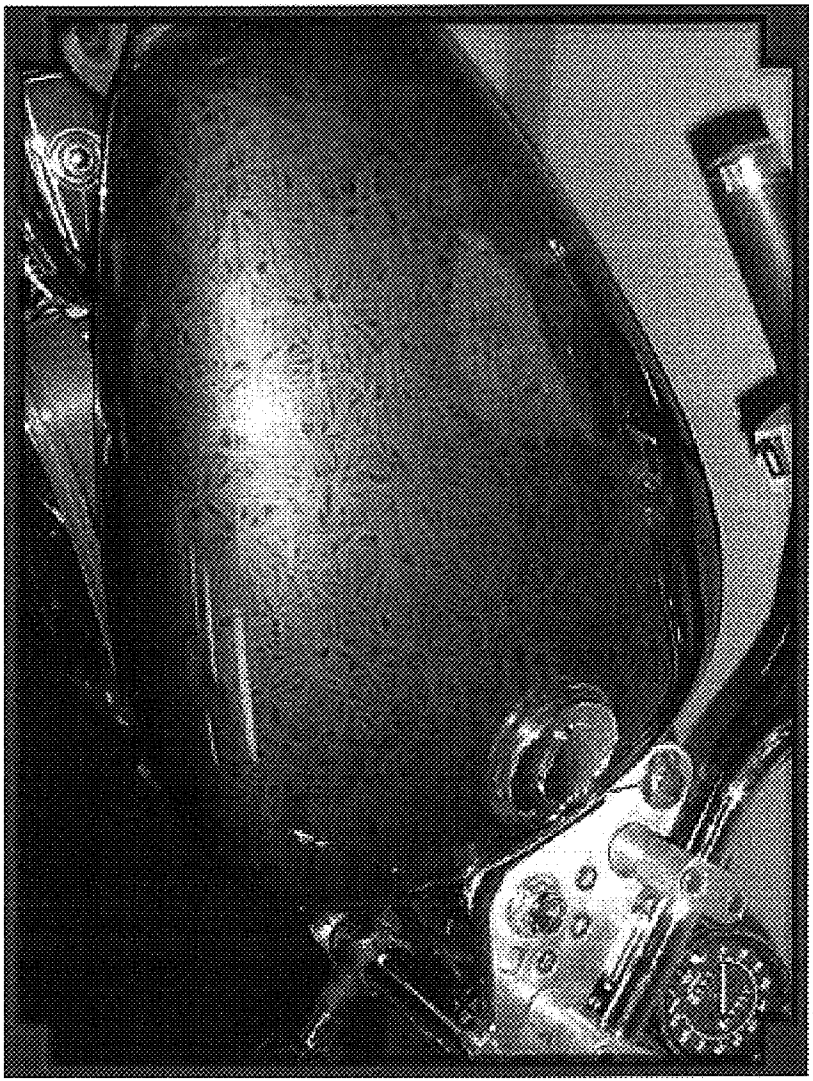
Figure 4:
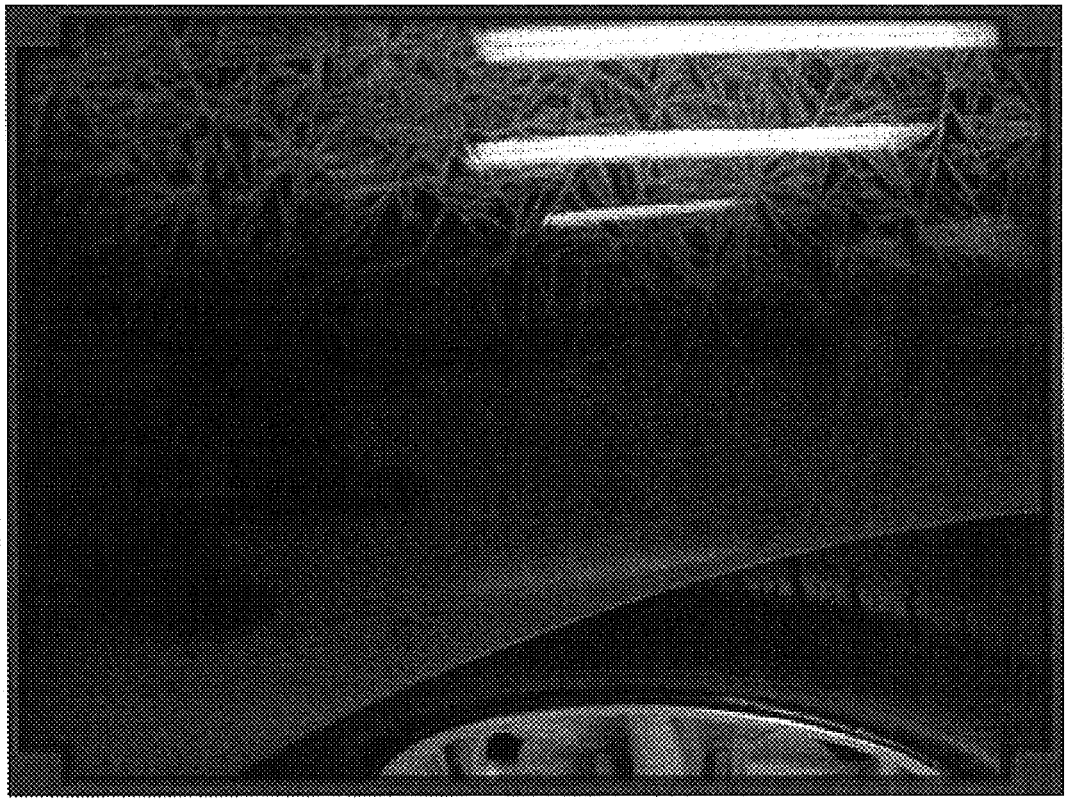

As illustrated in the attached FIGS. 1–4, the methods and compositions of the present invention can be used to provide unique finishes (such as a crystalline-patterned finish) on vehicle parts, such as the fenders or hoods of automobiles and trucks, or the gas tanks of motorcycles. Likewise, the methods of the invention can be used on furniture to create "faux" antique appearances (for instance, by the use of a combination of copper and brown paints sandwiching the patterning material), or to create distinctive patterns on customized musical instruments, like guitar bodies.

The following example is provided to further illustrate and explain a preferred form of the invention, and is not to be taken as limiting in any regard.

EXAMPLE

A steel surface is precoated with a dark blue oil base paint and dried. Once the surface is dry, it is lightly sanded with No. 6 sand paper. An aqueous solution containing 30% by weight urea and 1% by weight iso-propanol is then sprayed on the surface, and the surface is dried by using a small electric fan to blow air across the surface and by simultaneously heating the surface using heat lamps, resulting in the formation of a randomly distributed urea crystals on the surface. A coat of light blue oil-based paint is then sprayed on the surface and allowed to dry. The surface is washed with soapy water, thereby removing the soluble urea, and dried. The surface is then sprayed with varnish and allowed to dry, resulting in a crystalline appearance on the surface.

The invention thus being described, it will be obvious that the same may be varied in many ways. Such variations are not to be regarded as a departure from the spirit and scope of the present invention, and all such modifications as would be obvious to one of ordinary skill in the art are intended to be included within the scope of this invention.

What is claimed is:

1. A method for producing a pattern on an original surface of a substrate, comprising:

applying to the original surface a coating of a patterning composition which forms a crystalline pattern on the original surface;

applying a coat of paint to the original surface of the substrate and over the coating of the patterning composition; and removing the coating of the patterning composition and the coat of paint applied thereover to reveal a decorative crystalline pattern reflected in the paint remaining on the surface to which the coating of the patterning composition had been applied.

2. The method of claim 1, wherein the patterning composition comprises a nitrogenous composition.

3. The method of claim 2, wherein the nitrogenous composition comprises urea.

4. The method of claim 3, wherein the urea is present in the patterning composition in an amount of about 2.5% to about 50% by weight.

5. The method of claim 1, wherein the patterning composition further comprises a volatile solvent.

6. The method of claim 5, wherein the volatile solvent comprises an alcohol or a ketone.

7. The method of claim 1, wherein the patterning composition comprises an aqueous mixture.

8. The method of claim 1, which further comprises applying a coat of paint to the original substrate surface prior to the application of the patterning composition.

9. The method of claim 1, which further comprises applying a coating of a protectant material to the surface after removal of the patterning composition.

10. The method of claim 1, wherein the original surface of the substrate is non-porous.

11. A method for producing a decorative appearance on a surface, comprising the steps of:

providing a painted surface having a pattern;

applying a coating of patterning composition onto the painted surface;

applying a coating of paint to the painted surface and over the coating of patterning composition; and removing the coating of patterning composition and the coating of paint applied thereover to reveal a crystalline pattern in the paint remaining on the surface to which the coating of patterning composition was applied.

12. The method of claim 11, wherein the coating of patterning composition comprises a nitrogenous composition.

13. The method of claim 12, wherein the nitrogenous composition comprises urea.

14. The method of claim 13, wherein the urea is present in the patterning composition in an amount of about 2.5% to about 50% by weight.

15. The method of claim 14, wherein the patterning composition further comprises a volatile solvent.

16. The method of claim 11 further comprising the step of sanding the painted surface before applying the coating of the patterning composition onto the painted surface.

17. A method for producing a patterned surface, comprising the steps of:

providing a painted surface;

applying a coating of patterning composition onto the painted surface;

drying the coating of patterning composition;

applying a coating of contrasting paint to the painted surface and over the coating of patterning composition, after the coating of patterning composition has dried;

drying the coating of contrasting paint;

washing off the coating of patterning composition and the coating of contrasting paint to reveal a crystalline design in the paint remaining on the painted surface; and applying a protectant thereover.

18. The method of claim 17, wherein the coating of patterning composition comprises a nitrogenous composition.

19. The method of claim 18, wherein the nitrogenous composition comprises urea.

20. The method of claim 19, wherein the urea is present in the patterning composition in an amount of about 2.5% to about 50% by weight.

21. The method of claim 20, wherein the patterning composition further comprises a volatile solvent.

22. The method of claim 21 further comprising the step of sanding the painted surface before applying the coating of patterning composition onto the painted surface.

* * * * *